US005195725A

United States Patent [19]

Koopmans

[11] Patent Number: 5,195,725

[45] Date of Patent: Mar. 23, 1993

[54] DISPLACEABLE, TWO-PART WINCH DEVICE

[76] Inventor: Sietse J. Koopmans, No. 32, Buitenhaven, NL-2965 AE Nieuwpoort, Netherlands

[21] Appl. No.: 505,305

[22] Filed: Apr. 4, 1990

[51] Int. Cl.[5] ..... B66D 1/00

[52] U.S. Cl. ..... 254/266; 254/323

[58] Field of Search ..... 254/344, 361, 362, 323, 254/325, 266

[56] References Cited

U.S. PATENT DOCUMENTS 2,344,681 3/1944 Deschner .

FOREIGN PATENT DOCUMENTS 2217379 11/1973 Fed. Rep. of Germany .
2757307 7/1979 Fed. Rep. of Germany .
2325596 4/1977 France .
8103443 9/1982 Netherlands .
8501649 1/1987 Netherlands .
1522985 8/1978 United Kingdom .

*Primary Examiner*—Katherine Matecki
*Attorney, Agent, or Firm*—Wegner, Cantor, Mueller & Player

[57] ABSTRACT

Displaceable winch device comprising a separate drive unit with an output drive shaft and a separate winching unit connectable thereto, wherein said drive unit comprises a frame, a unit compartment with a combustion motor delimited within said frame, a drive gear coupled thereto and comprising said output drive shaft, and a motor cooling water cooler, and in addition an operating compartment in which is arranged a seating position having operating means grouped therearound. Said frame reaches substantially to just above the seat of said seating position, that said unit compartment extends beneath said seating position and that said cooling water cooler is fitted in the portion of said unit compartment extending beneath said seating position.

8 Claims, 4 Drawing Sheets

1
2
3
28
29
30
31

6
8
17
25
26
32
33
34
35
36
IV

DISPLACEABLE, TWO-PART WINCH DEVICE

The present invention relates to a displaceable winch device comprising a separate drive unit with an output drive shaft and a separate winching unit connectable thereto, wherein the drive unit comprises a frame, a unit compartment with a combustion motor defined within the frame, a drive gear coupled thereto and comprising the output drive shaft and a motor cooling water cooler, and in addition an operating compartment in which is arranged a seating position having operating means grouped therearound.

Such a winch device is known from the Netherlands patent application 85.01649. Because it is divided in two, this known winch device has the advantage that it can be moved with comparatively light transporting means. The known device can hereby still be used for oil exploration in little accessible areas. In exploration areas which are so inaccessible that the necessary equipment has to be transported through the air, and particularly by helicopter, to the drilling location, the known device is however unusable.

The invention now has for its object to further develop a device that can be moved with helicopters normally used in oil exploration.

With a winch device according to the invention this is achieved in that the frame reaches substantially to just above the seat of the seating position, that the unit compartment extends beneath the seating position and that the cooling water cooler is fitted in the portion of the unit compartment extending beneath the seating position. The two units of the winch device can hereby have on the one hand very limited dimensions and on the other a minimal weight, since because of the limited dimensions the use of a minimum of material can suffice, particularly for the frame. Both the drive unit and the winching unit can have a length and breadth of respectively 1.5 and 1 m with a height of 1.10 m. These minimum dimensions enabled as a result of the steps according to the invention make it possible to limit the weight to approximately 900 kg so that the units can be transported by helicopter.

Despite the limited dimensions a very good cooling air supply and discharge is hereby possible so that the device can be used without problem in tropical conditions.

A hinged cover is preferably applied particularly in order to protect the operating means.

In accordance with another feature of the invention, the hinged cover, when closed, covers the cooling air feed and discharge opening in the transporting situation. In the folded-open state of the cover the relevant opening is thereby automatically released.

With the cover comprising three portions standing at right angles to each other, the cover is also used effectively in the folded-open state since it forms a shelter for the operator.

When the drive unit and winch unit are interconnected and their covers are fully opened, the operative can the operation work while entirely sheltered and closely observe the operation of the winch through the window. In the inaccessible regions where the device according to the invention has to be used transporting means for moving the winch device units on site are not always available. Due to the low weight and the small dimensions obtained according to the invention it is possible to move the units using manpower. Auxiliary frames can be temporarily attached for raising and moving each unit. By winding up the screwed spindles, each unit is subsequently raised from the ground and can be moved, using the wheels, to the desired location. There the unit can be lowered, the auxiliary frames removed and the other unit of the winch device can then be maneuver to the desired position against the first unit.

The invention will be further elucidated in the following description with reference to the annexed figures wherein an embodiment of the device is shown.

Figures 1, 2, 3:
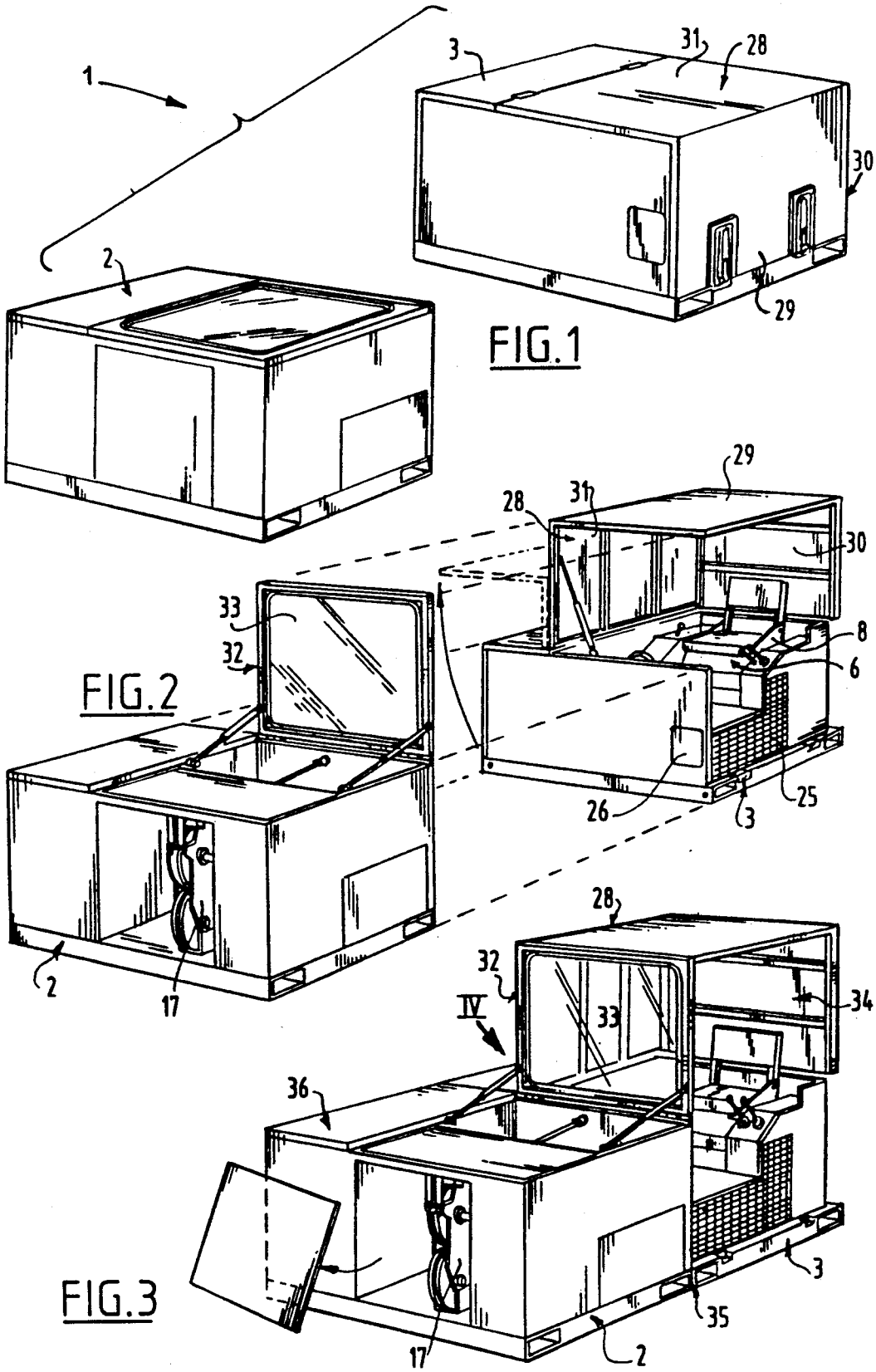
FIG. 1 shows the two units of the winch device according to the invention in perspective view and in the transporting situation.
FIG. 2 shows a view corresponding with FIG. 1 of the units of FIG. 1 with folded-open covers.
FIG. 3 shows a view corresponding with FIG. 1 and 2 of the units of the device in assembled and ready for use position.
Figure 5:
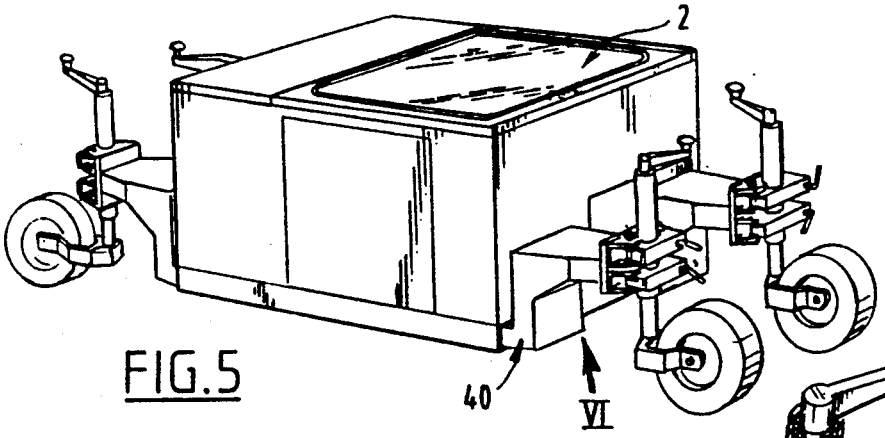
FIG. 5 shows the winching unit of the device according to the invention during displacement.
Figure 6:
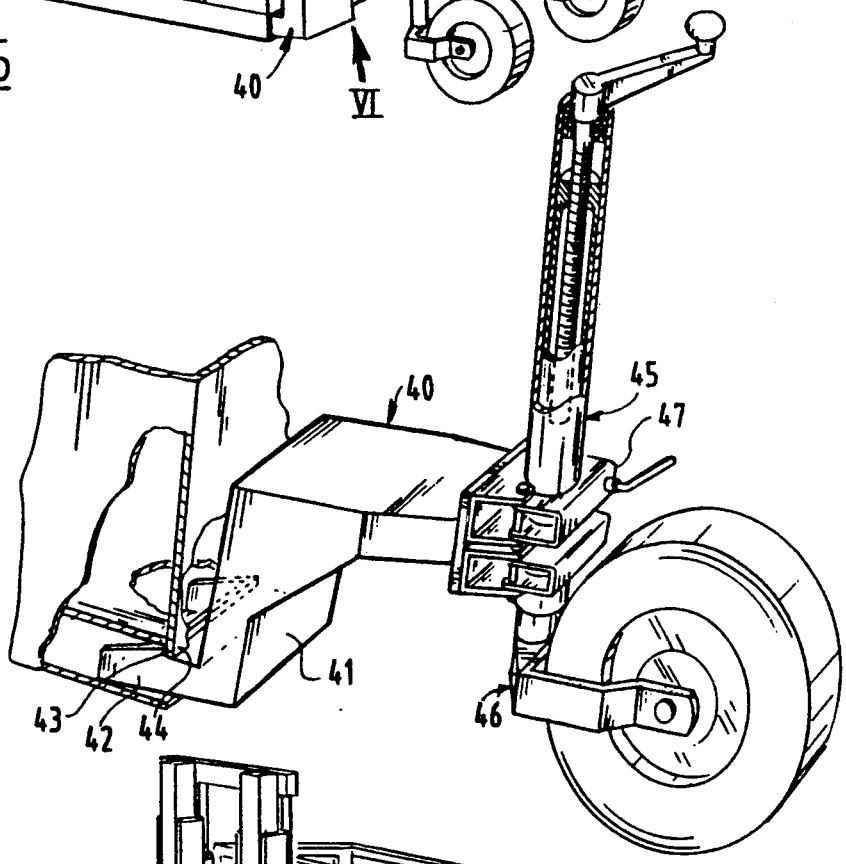
FIG. 6 is a partly broken away perspective detail view along arrow IV in FIG. 5.

The winch device 1 shown in FIG. 1 comprises a separate winching unit 2 and a separate drive unit 3. In the transporting state shown in FIG. 1 the units 2 and 3 form closed cases of very limited dimensions and weight which can be transported by a helicopter.

Figure 4:
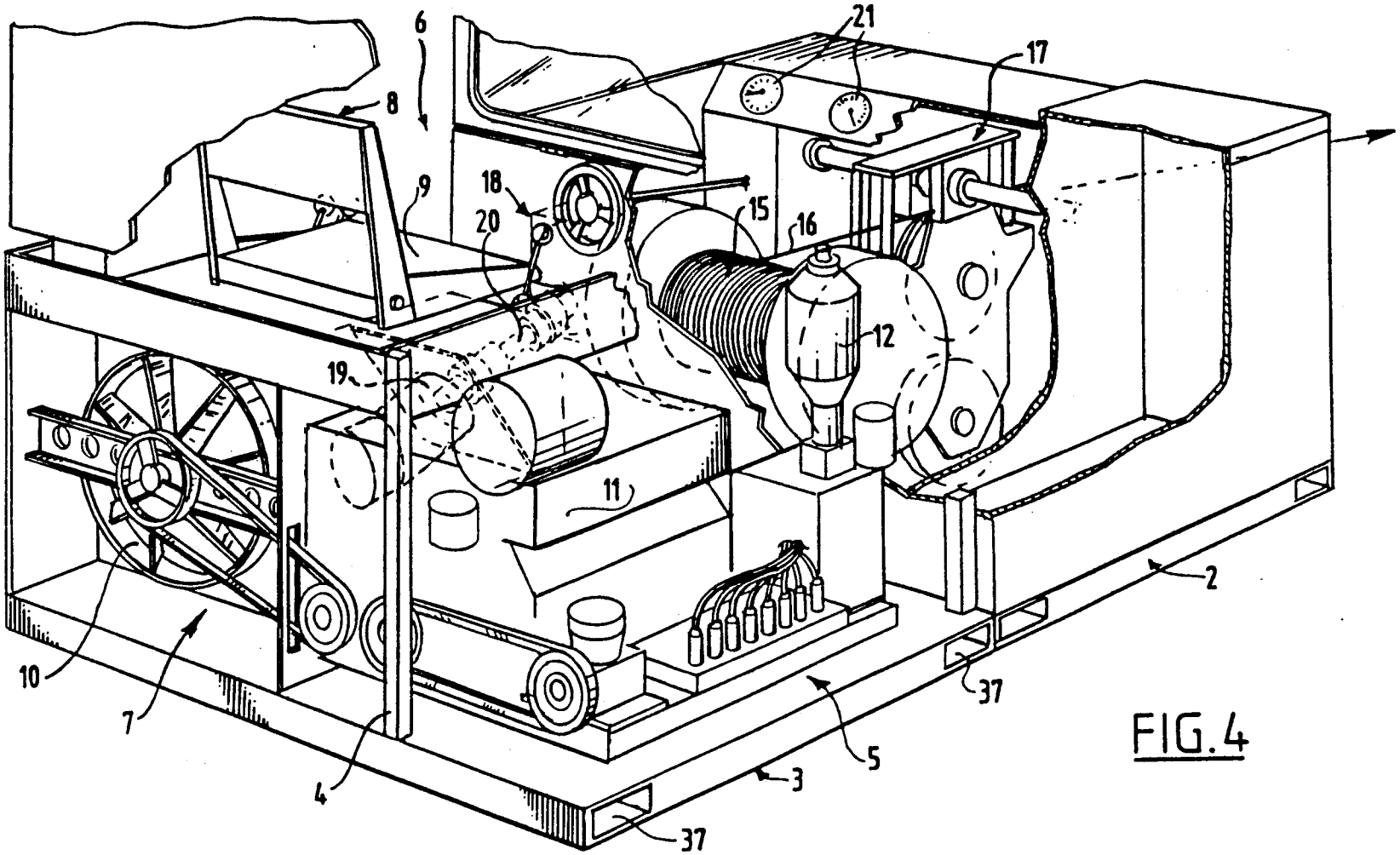
FIG. 4 is a partly broken away perspective view along arrow IV in FIG. 3.

As FIG. 4 clearly shows, the drive unit 3 has a unit compartment 5 and an operating compartment 6. Arranged in the operating compartment 6 is a seating position 8 with a seat 9 and a folding back support. The frame 4 of the unit 3 reaches to just above the seat 9 of seating position 8. The unit compartment 5 has a portion 7 that extends beneath the seating position 8. Mounted in this portion 7 of the unit compartment is the cooler 10 in which the cooling water of the motor 11 is cooled. The unit compartment 5 contains in addition to the combustion motor 11, an hydraulic drive gear coupled thereto and all the elements necessary for the independent operation of the device.

Since the device according to the invention is intended for use as wire-line-unit, the unit is provided with all the safety devices necessary to be able to function safely in an environment with explosion risk. The motor 11 is thus not provided with an electrical starting device and the battery required therefor, but the motor is started from a hydromotor which is driven with hydraulic energy from an accumulator 12. The extra provisions required for safety occupy much space. However, precisely because the cooler is arranged in the space under the seating position it is possible to accommodate all the necessary components in the above mentioned limited dimensions.

As can be seen in the figures, the unit compartment 5 is located substantially at the side of the operating compartment 6. In the device shown the cooler 10 comprises a suction fan and the cooling air is fed through a cooling air feed opening on the side of the operating compartment remote from the motor. The cooling air feed opening is, as can be seen in FIG. 2 and 3, provided with a grating 25. The cooling air discharge takes place on the side of the operating compartment to the rear of the seating position 8. As a result of this arrangement a large quantity of cooling air can be supplied to the cooler 10 and be discharged again therefrom unobstructed, so that the device can also function well at high temperatures.

The winching unit 2 further comprises in per se known manner a winch drum 15 on which is wound a winch wire 16. The winch wire is trained through a measuring/guiding device 17 which is mounted for displacement in transverse direction in front of the winch drum. With the measuring/guiding device 17 is measured the tensile force in the winch wire 16 and the paid-out length of the winch wire 16. The measured values are shown on the meters 21.

The winch drum is driven using a drive gear 18 which is coupled via a coupling shaft 20 to a hydromotor 19 which is fixedly mounted in the drive unit 3. The coupling shaft 20 is only fitted after the winch unit 2 and the drive unit 3 are disposed against one another and mutually coupled. Indicated in FIG. 2 is the opening 26 through which the coupling shaft extends in the ready for use situation. The hydromotor 19 is situated behind the previously mentioned cooling air grating 25 and the coupling shaft can be arranged by temporarily removing this cooling air grating 25.

As shown in FIG. 1 and 2, the drive unit 3 is provided with a cover 28 which closes off the operating compartment 6 in the non-use situation. The cover 28 hinges on the side adjoining the unit compartment and comprises three portions 29, 30 and 31 standing at right angles to each other. In the transporting situation shown in FIG. 1 the cover portion 31 covers off the top side of the operating compartment 6, the cover portion 29 covers off the side of the device containing the cooling air intake and the cover portion 30 covers off the cooling air discharge.

As shown in particular in FIG. 2, the cover 28 forms in the folded-open position a side, rear and top wall of the operating compartment 6. The operative seated on the seating position 8 is therefore sheltered by the cover 28. The winch unit 2 is likewise provided with a cover 32. In the assembled state of the device shown in FIG. 3, this cover hinges on the side located close to the operating compartment. The cover 32 is provided with a window 33 of impact resistant, transparent material and forms, as FIG. 3 shows, a transparent front wall of the operating compartment 6 in the assembled state of the device. The cover 28 of the drive unit 3 and the cover 32 of the winch unit 2 thus form together the upper part 34 of the operating compartment. The operative can observe the operation of the winch device through the window 33.

The winch unit 2 and drive unit 3 placed abutting one another are mutually joined at the underside designated generally with 35, for example by a bolt connection.

The winch unit 2 is provided adjacent to the winch compartment with a tool compartment 36 which likewise bears a folding cover. In this tool compartment 36 the coupling shaft for example is stored during transport in addition to further components necessary for the operation of the device.

Figure 7:
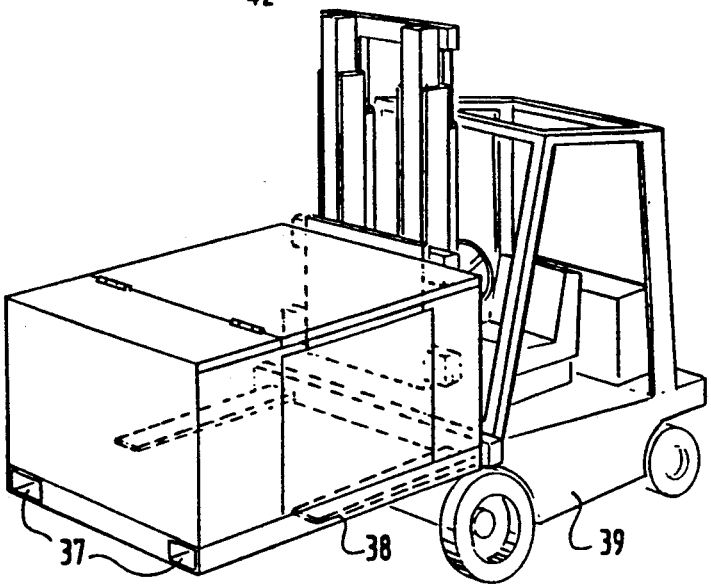
FIG. 7 illustrates another possibility of displacing a unit of the device according to the invention.

Both the winch unit 2 and the drive unit 3 are provided close to their underside with two parallel channels 37 for insertion therein of the fork 38 of a fork-lift truck 39, as shown in FIG. 7. The units 2 and 3 of the device can be easily moved in this manner.

Where there is no fork-lift truck 39 or like transporting means available, particularly at the drilling location where the winch device 1 according to the invention has to be used, the units 2 and 3 can be moved using four auxiliary frames 40 which are placed into the ends of the channels 37 and each of which is provided with a swivel wheel 46 that is downwardly movable by a screwed spindle device 45.

The auxiliary frames are generally Z-shaped. Protruding at the bottom end from the basic part 41 is a horizontal foot 42 which can be inserted into the channel 37 of one of the units 2, 3. On the upper side the foot 42 is provided with a standing edge 43 which grips behind a downward protruding edge 44 of the unit.

The swivel wheel 46 with the screwed spindle device 45 connected fixedly thereto is per se known, and is used in typical manner for instance in automobile trailers. The screwed spindle device 45 is clamped fixedly with an outer pipe on the auxiliary frame 40 at a suitable height by means of clamping brackets 47. When the wheel 46 is moved fully upward the foot 42 of the auxiliary frame 40 can be inserted into the opening of the channel 37. When the wheel 46 is subsequently screwed downward, the auxiliary frame 40 tilts upwards and the edge 43 on the insert foot 42 engages behind the downward edge 44 close to the opening of the channel 37. The auxiliary frame 40 can then no longer be released from the opening of the channel 37. With further screwing down of the wheel 46 the unit is raised up. The two wheels on one side can be wound up simultaneously by one person. The two other wheels can then be wound up. As soon as the assembly rests on the four wheels it can be displaced over the ground surface into the desired position. By again winding up the wheels 46 the moved unit is once again set on the ground. The auxiliary frames 40 are removed and inserted in the manner described into the other unit, whereafter the second unit can be maneuvered to the correct position adjoining the first displaced unit. In this manner the winch device according to the invention can therefore be disposed at the appropriate location within a limited space and using manpower.

Figure 8:
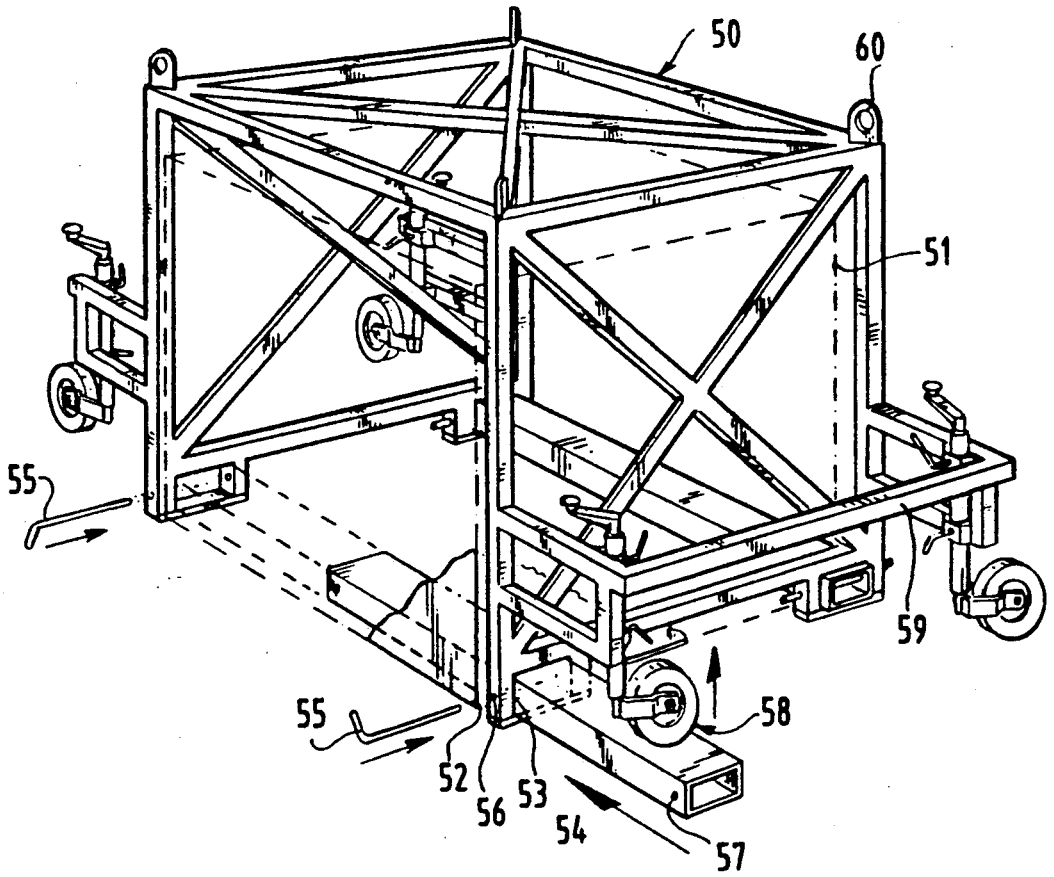
FIG. 8 shows an auxiliary frame according to another embodiment for use during transport and displacement.

The auxiliary frame 50 shown in FIG. 8 is suitable for displacing the winch unit or drive unit, the periphery whereof is indicated with dashed and dotted lines 51, but may also be used for example for transporting the winch or drive unit 51 through the air. The frame 50 forms a protection of the unit 51 during transportation.

The unit 51 is connected to the frame 50 using the above mentioned channels 52 arranged in the unit 51 and into which can also be inserted the forks of a fork-lift truck. The frame 50 is provided with openings 53 corresponding to these channels. The frame is placed around the unit 51 such that the openings 53 come to lie in register with the channels 52. A beam 54 is then placed through the channel 52 into the opening 53 of the frame at the opposite end. The beam 54 is locked using locking pins 55 which are placed through holes 56 in the auxiliary frame 50 and holes 57 in the beam 54 that lie in register in the inserted position of the beam 54.

As shown, the auxiliary frame 50 comprises on either side a support portion 59 on each of which are fitted two of the above described screwed spindle wheels 58. As FIG. 8 shows, during sliding in of the beam 54 a wheel 58 in front of the opening 53 is screwed upward to allow passage of the beam 54.

After the beams 54 are arranged in the above described manner, the screwed spindle wheels 58 can be screwed down and the unit 51 thus becomes mobile.

The frame 50 is also provided with lifting lugs 60 so that a unit 51 arranged in the auxiliary frame 50 can be hoisted and displaced with a crane or a helicopter. Using the auxiliary frame 50 the units 51 can be transported in a safe manner and be maneuvered at the location of use into the correct position. As soon as the unit is placed in the correct position the wheels 58 are screwed upward so that the unit 51 and the auxiliary frame 50 come to support on the ground and the beams 54 are removed. Thereafter the wheels 58 can be screwed down again and the auxiliary frame 50 can be moved away.

After joining the two units to one another, folding up the covers 28, 32 and arranging the coupling shaft 20, the winch device is ready for use.

I claim:

1. In a displaceable winch device comprising a drive unit and a winching unit which is separable from said drive unit for a transporting state and connectable thereto for a state of use as a winch, said drive unit having an output drive shaft and drive gear, a frame, a unit compartment means for housing a combustion motor and a radiator said radiator providing means for cooling a coolant of said motor, and an operator compartment provided with a seat for an operator of said winch and controls situated about said seat within reach of said operator, the improvement comprising:

said frame protruding just above a horizontal top surface of said seat;

at least a portion of said unit compartment means extending beneath said seat; and said radiator being fitted in said portion of said unit compartment means.

2. The improvement as in claim 1, and further comprising:

said unit compartment means being substantially situated to one side of said operator compartment;

an intake opening for entrance of air to said radiator, said intake opening being situated in a sidewall of said drive unit and on an opposite side of said operator compartment from said one side;

a discharge opening for egress of air from said radiator, said discharge opening being situated in a sidewall of said drive unit and behind said operator compartment.

3. The improvement as in claim 1, and said drive unit further comprising:

a drive unit cover situated on an upper side of said frame and closeable over said operator compartment for said transporting state of said winch device.

4. The improvement as in claim 3, and further comprising:

said drive unit cover being hinged to said frame on said one side and further extending down said other side of said operator compartment when in said transporting state.

5. The improvement as in claim 4, and said drive unit cover further comprising:

cover portions which cover said intake and discharge openings when in said transport state, said cover portions serving as a ceiling and a rear wall of said operator compartment when opened into said use state.

6. The improvement as in claim 5, wherein said winch unit comprises:

a winch unit cover provided with a window, said winch unit cover being hinged on a connection side of said winch unit which is adjacent said operator compartment in said use state of said winch device and, together with said cover portions of said drive unit, forming an upper operator compartment portion which is open on only one side in said use state of said device.

7. The improvement as in claim 1, wherein each of said drive and winch units comprise:

channel means for receiving ends of lifting devices by which said units are raisable and movable.

8. The improvement as in claim 7, and further comprising:

auxiliary frame means for removeably and interchangeably attaching to said channel means and for lifting and moving each of said drive and winch units.

* * * * *